United States Patent [19]

van der Poel

[11] Patent Number: 4,518,436

[45] Date of Patent: May 21, 1985

[54] PROCESS FOR THE PRODUCTION OF GRAFT CRYSTALS FOR USE IN SEEDING SUGAR BOILING BRINES

[75] Inventor: Pieter W. van der Poel, Prinsenbeek, Netherlands

[73] Assignee: CSM Suiker B.V., Amsterdam, Netherlands

[21] Appl. No.: 531,926

[22] Filed: Sep. 13, 1983

[30] Foreign Application Priority Data

Sep. 23, 1982 [EP] European Pat. Off. ..... 82201191.2

[51] Int. Cl.[3] ..... C13F 1/02

[52] U.S. Cl. ..... 127/60; 127/16; 127/62

[58] Field of Search ..... 127/15, 16, 58, 60, 127/61, 62

[56] References Cited

U.S. PATENT DOCUMENTS

| | | | |
|---|---|---|---|
| 3,356,532 | 12/1967 | Grandadam | 127/58 |
| 3,503,803 | 3/1970 | Bennett et al. | 127/16 |
| 3,617,382 | 11/1971 | Natsis | 127/15 |
| 3,642,534 | 2/1972 | De Cremoux | 127/58 |
| 3,695,932 | 10/1972 | Randolph et al. | 127/60 |
| 4,004,886 | 1/1977 | Thijssen et al. | 62/541 |
| 4,145,230 | 3/1979 | Madsen et al. | 127/60 |
| 4,164,429 | 8/1979 | Mercier | 127/62 |

FOREIGN PATENT DOCUMENTS

| | | |
|---|---|---|
| 709700 | 5/1968 | Belgium . |
| 2073064 | 8/1971 | France . |
| 418260 | 2/1967 | Switzerland . |

OTHER PUBLICATIONS

International Sugar Journal, Band 79, Nr. 937, Jan. 1977, Seiten 10–14, R. F. Madsen: "Vacuum Pan Automation and Sugar House Computer Control", * Seiten 10–14.

R. A. McGinnis, "Beet-Sugar Technology", 1951, Seiten, 404–410, Reinhold Publishing Corp., New York, USA, * Seiten 404–408.

*Primary Examiner*—Peter Hruskoci

*Attorney, Agent, or Firm*—Brumbaugh, Graves, Donohue & Raymond

[57] ABSTRACT

The production of graft crystals for use in seeding sugar boiling brines is achieved by means of adding milled sugar of a grain size of 5–20 micrometer to a sugar solution with a supersaturation number of 1.12–1.20 and a volume of 1.8–2.2% of the final volume, homogenization of the mixture by means of a circulation pump and control of the crystallization by maintaining the pressure in the crystallization unit such that the liquid evaporates and the temperature decreasing maintaining the supersaturation number in the range of 1.12–1.20.

2 Claims, 1 Drawing Figure

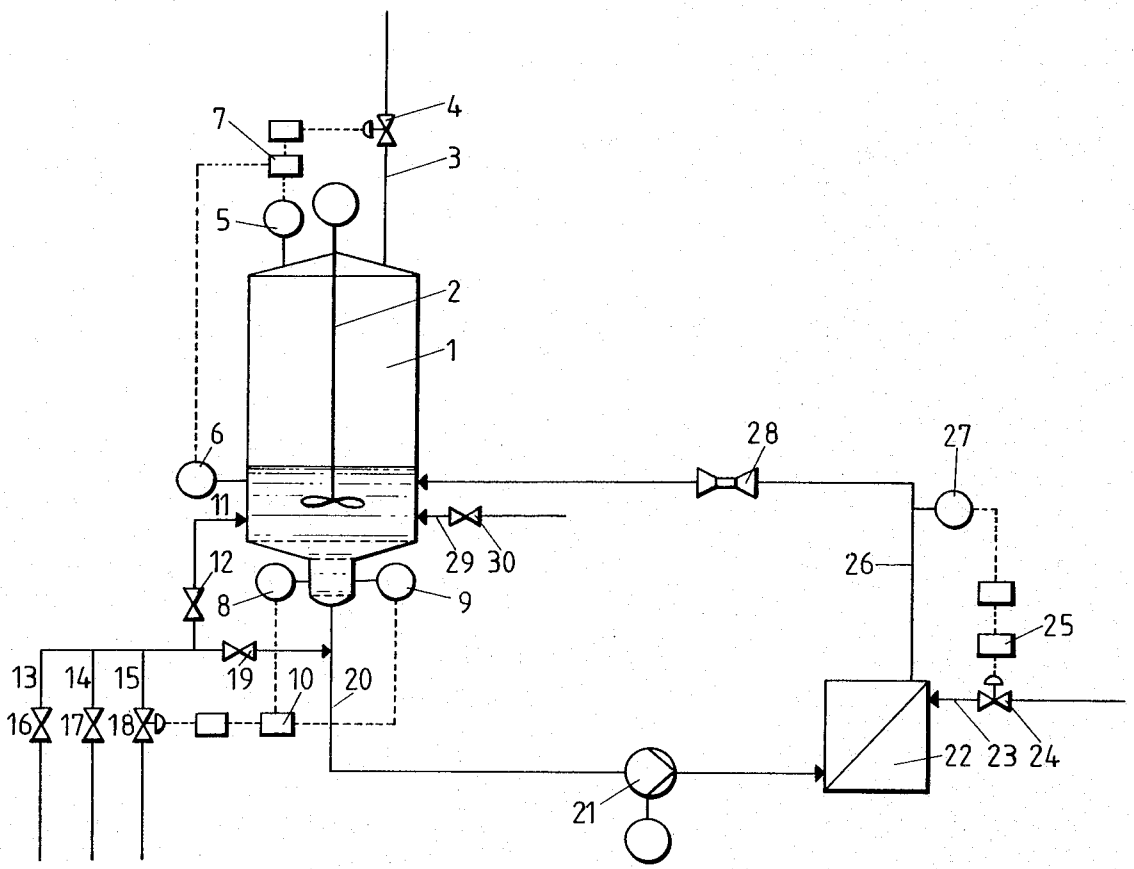
1
2
3
4
5
6
7
8
9
10
11
12
13
14
15
16
17
18
19
20
21
22
23
24
25
26
27
28
29
30

PROCESS FOR THE PRODUCTION OF GRAFT CRYSTALS FOR USE IN SEEDING SUGAR BOILING BRINES

The invention relates to a process for the production of grafting crystals for sugar boiling brines by the addition of crystal sugar, milled sugar or a sugar suspension to a highly concentrated sugar solution.

The common prior art process is described in R. A. Mc Ginnis' Beet-sugar Technology pages 404–408 for instance. Such a process mainly consists in the following measures:

1. A crystallizer having a total volume of 20–60 $m^3$ is filled with such a quantity of sugar solution that the inner heating element is under the liquid level. The solution is concentrated to the supersaturation number necessary for the formation of the crystals or the crystal growth respectively, is reached. During the concentration, it is seen by means of addition of a sugar solution that the heating element is maintained beneath the liquid level.

2. The supersaturated solution is grafted with powder sugar, crystal sugar or a suspension of milled sugar in isopropanol.

3. The supersaturation is maintained by evaporation of water causing the desired crystal growth. During this growth continuously fresh sugar solution is added and the supersaturation number is controlled as precisely as possible by evaporation of water and the addition of fresh sugar solution until the crystallizer is filled. Thus a mass of about 60% by weight of crystals in a supersaturated solution is obtained and 4. When the crystallizer is filled, a stable supersaturation number is maintained and the mixture is crystallized to an optimum yield of crystals.

To promote the evaporation a diminished pressure is always maintained during such a process. In the first phase of the process it is difficult to prevent conglomeration of the crystals. Furthermore fine secondary crystals are easily formed, causing a heterogeneity of the final product due to the big difference in the size of the crystals.

To eliminate temperature fluctuations, the diminished pressure is kept as constant as possible.

Such a process is also briefly described in "De Nederlandse Suikerindustrie" (1979), pages 44 and 45.

In practice the grafting is performed in a crystallizer provided with an inner heating element and having a total volume of 20–60 $m^3$ in which the heating element is immersed in a supersaturated solution. The volume indicated is about 30% of the final volume of the crystal mass in the crystallizer.

The grafting is performed by addition of a quantity of crystal sugar, powdered sugar, milled sugar or a sugar suspension to the supersaturated solution. The graft crystals cause a formation of germs or seeds in which the formation of the final number of germs is determined by the time of the process and the supersaturation number of the solution in which there is further grafting.

When the desired number of crystals is formed, the germation is stopped. The stopping is performed by a decrease of the supersaturation number. The decrease can be caused by drawing in a quantity of unsaturated sugar solution, drawing in a quantity of water or increasing the temperature (it is called drawing in since in view of the diminished pressure in the crystallizer opening of a valve results in drawing in a quantity of unsaturated sugar solution, water or the like into the crystallizer from a container under normal pressure).

In this process the result obtained depends on the construction of the crystallizer and the experience of the operator. In many cases an irregular crystal with a great number of conglomerates and a very large grain size distribution is obtained. The last mentioned aspects are disadvantageous in view of the quality of the final product since the removal of the mother-lye which is usually caused by centrifugation is hampered.

A further disadvantage of this known process is that it is mostly required to draw in large quantities of water to stop the germ formation which quantities have to be evaporated again and thus causes an increase of the energy needed.

It has now been found that graft crystals with a considerably more uniform grain size distribution can be obtained by adding a suspension of milled sugar having a grain size of 5–20 micrometers to a concentrated sugar solution having a supersaturation number of 1.12–1.20, the suspension being added in a volume which is 1.8–2.2% of the total volume of the resultant mixture, and forming the graft crystals in a crystallizer without a heating element, in which the mixing is performed by means of a circulation pump and the crystallization is controlled by adjusting the pressure in the crystallizer such that liquid evaporates and the temperature is lowered, whereby the pressure decrease and/or the temperature are adjusted so that the supersaturation number is maintained within the range of 1.12–1.20.

Due to the crystallization the supersaturation number decreases. This number, however, is controlled by the pressure in the crystallizer such that the temperature of the solution is controlled by means of the water evaporation. The water evaporation as such is controlled by means of the pressure above the liquid. It is important that in contrary to the usual practice in this phase of the process no heat is added. The volume used in this graft process is smaller than the usual volume. Preferably a decrease of temperature of 0.4°–1.0° C. per minute, especially 0.6° C. per minute is used. This results in very good crystals.

By my experiments it was found that it is expedient to use a volume of about 1 $m^3$ with a crystallizer of a volume of 60 $m^3$. The supersaturation number of the sugar solution is adjusted precisely i.e. at 1.16 for instance. The grafting can be performed in this volume with a suspension of milled sugar in isopropanol expediently at a concentration of 25–50 vol % of sugar, especially 31–35 vol % of sugar, preferably 33 vol % of sugar.

The grain size of the milled sugar in this suspension is 5–20 micrometers for instance, especially 8–12 micrometers.

The crystallization is then performed in such a way that the supersaturation is controlled by the cooling. Said cooling is obtained by evaporation of the liquid in which the evaporation is controlled by the pressure in the crystallizer.

In this process the temperature of the boiling suspension is expediently brought at 75°–100° C., especially at 82°–87° C. and often at 85° C. The supersaturation number is determined by means of the viscosity of the sugar solution; such a viscosity is several hundreds mPa.s.

When the desired supersaturation number of the sugar solution is reached, the suspension is added and the boiling suspension is cooled to 85°–75° C. As already mentioned, said cooling is performed by means of evaporation of the liquid. Such an evaporation is expediently performed within 10–30, especially within 17–25 minutes. An expedient pressure is 60–80 centibar.

The diminished pressure is controlled by means of pressure regulation in the crystallizer whereafter the temperature is controlled by the water evaporation. The regulation of the diminished pressure is controlled by means of a computer program resulting in an optimum crystallization and a thorough suppression of the secondary germ formation.

The obtained water vapor is removed by suction to maintain the diminished pressure. When the graft crystals have reached a size of 100 micrometers the crystallization can be continued by the introduction of heat by means of steam.

In this process a graft material with a grain size of about 200 micrometers is obtained in which the grain size distribution is relatively small as already has been indicated. The construction of the apparatus is such that in the heat exchanger an unsaturated solution is obtained by heating and circulation. By means of regulation of the residence time in the unsaturated zone and of the greater or less degree of unsaturation it is caused that the secondary germ formation is prevented and that the smallest crystals are dissolved again.

In practice it appeared that by grafting in the usual crystallizers with the obtained graft crystal a more uniform grain size distribution in the final product was obtained.

The process of the invention is different from the known process in that the total process can be automatized very well, a very small grafting volume of 1 $m^3$ for instance can be used, the solution with crystals to 100 micrometers are mixed by means of a circulation pump, the number of crystals is only determined by the quantity of suspension and the number of crystals can be controlled better, the supersaturation number is regulated by cooling instead of evaporation by means of steam until a crystal size of 100 micrometers is obtained, the number of conglomerates is lowered to a minimum, the small crystal germs dissolve again in the unsaturated solution of the heat exchanger during the boiling, whereby the unsaturation of the solution can be controlled by means of (a) the adjustment of the temperature difference by means of the heat exchanger and (b) the place of the mixed solution in the circulation circuit or in the crystallizer.

The residence time in the unsaturated zone is controlled by the circulation pump and amounts in general to 5–25 seconds.

In the present process, the horizontal mixing can be reached by means of a stirrer, however, the vertical mixing is realized by means of a circulation pump. In case a stirrer is used in the crystallizer, it is constructed so that the mixing occurs layerwise.

BRIEF DESCRIPTION OF THE DRAWING.

The drawing shows a suitable apparatus to perform the present process.

In the apparatus shown in the annexed drawing 1 is the crystallizer wherein the graft crystals are formed, 2 indicates a stirrer which is constructed so that it causes a layerwise mixing, 3 indicates an outlet conduit for evaporation, which can be connected with a vacuum and which is provided with a valve 4, 5 is a means to measure the pressure and 6 is a means to measure the temperature. Both 4, 5 and 6 are connected to a means 7, which controls the performance of a predetermined program. Furthermore the crystallizer is provided with a level meter 8 and a means to measure the viscosity 9. Means 8 and 9 are in their turn connected with a means 10 for data processing, which means 10 can be connected with means 7.

Furthermore an inlet conduit 11 with a valve 12 is provided below the usual liquid level which conduit is connected with a water supply conduit 13, a A-syrup supply conduit 14 and a mixed sap supply conduit 15, provided with valves 16, 17 and 18 respectively, which at their turn are connected with control means 10. Via a valve 19 supply conduits 13, 14 and 15 are also connected to discharge conduit 20, which is mounted in the bottom of the crystallizer. This discharge conduit 20 is provided with a pump 21 to pump the liquid and this conduit is further provided with a heat exchanger 22, expediently constructed as a plate heat exchanger. Said plate heat exchanger is heated via a steam conduit 23 provided with a valve 24. Valve 24 is controlled by controlling means 25, which can be combined with means 7 and 10. The product passed via heat exchanger 22 is recirculated to the crystallizer via conduit 26, which contains a means 27 to measure the temperature, connected to control means 25. Said conduit is furthermore provided with a resist 28 of 0.2 bar.

Finally a supply conduit 29 is connected to the crystallizer, which conduit is provided with a valve 30 which serves to supply the suspension and a discharge conduit (not shown) for discharging the suspension obtained from the crystallizer and which is also provided with a valve (not shown).

The improved quality of the graft crystals obtained by processing in accordance with the present invention decreases the amount of enclosed mother-lye. Therefore an improved quality of the final product is obtained and the expenditure of energy is lowered because the improvement of the crystal quality requires a lower crystallization.

In the following table the results obtained with graft crystals of a usual production of graft crystals in a usual crystallizer and that of the present process are compared.

| | known process | present process |
|---|---|---|
| conglomerates, % | 81.8 | 13.7 |
| ash × 1000, % | 11.8 | 7.0 |
| average of the grain size in mm | 0.58 | 0.64 |

The decreased ash contents and the small number of conglomerates give an indication of the improvement of the crystal quality.

I claim:

1. A process for the production of graft crystals for use in seeding sugar boiling brines which comprises (a) adding an isopropanol suspension of milled sugar having a grain size of 5–20 micrometers to a concentrated sugar solution having a supersaturation number of 1.12–1.20 in a crystallizer, the suspension being added in a volume which is 1.8–2.2% of the total volume of the resultant mixture, (b) homogenizing the mixture by means of a circulation pump, (c) controlling crystallization to form graft crystals having a grain size of about 200 micrometers by lowering the pressure in the crystallizer to 60–80 centibars to cause evaporation of liquid, which evaporation lowers the temperature of the mixture to 75°–100° C., and (d) adjusting the pressure and temperature to maintain a supersaturation number of 1.12–1.20.

2. The process according to claim 1, which further comprises, after the graft crystals have reached an initial grain size of about 100 micrometers, supplying steam to the crystallizer by means of a heat exchanger located outside of the crystallizer to promote dissolution of any fine secondary crystals.

* * * * *

UNITED STATES PATENT AND TRADEMARK OFFICE

CERTIFICATE OF CORRECTION

PATENT NO. : 4,518,436

DATED : May 21, 1985

INVENTOR(S) : Pieter W. van der Poel

It is certified that error appears in the above-identified patent and that said Letters Patent is hereby corrected as shown below:

Col. 1, line 7, "grafting crystals for" should read -- graft crystals for use in seeding --.

Signed and Sealed this

*Twenty-second* Day of *October 1985*

[SEAL]

*Attest:*

DONALD J. QUIGG

*Attesting Officer*

*Commissioner of Patents and Trademarks—Designate*